US006481490B1

(12) United States Patent
Vihtelic et al.

(10) Patent No.: US 6,481,490 B1
(45) **Date of Patent: *Nov. 19, 2002**

(54) INVESTMENT CASTING PATTERNS AND METHOD

(75) Inventors: Joseph M. Vihtelic, Whitehall, MI (US); Philip D. Jackson, Muskegon, MI (US); Jiri E. Kresta, Warren, MI (US); Kurt C. Frisch, Grosse Ile, MI (US)

(73) Assignee: Howmet Research Corporation, Whitehall, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/237,435

(22) Filed: Jan. 26, 1999

(51) Int. Cl.[7] ..... B22C 7/02; B22C 9/04

(52) U.S. Cl. ..... 164/516; 164/34; 164/45; 164/235

(58) Field of Search ..... 164/516, 34, 45, 164/235

(56) References Cited

U.S. PATENT DOCUMENTS

| | | | | |
|---|---|---|---|---|
| 3,747,663 | A | 7/1973 | Taylor | 164/25 |
| 3,942,583 | A | 3/1976 | Baur | 164/246 |
| 4,064,927 | A | 12/1977 | Ostrowski | 164/244 |
| 4,240,492 | A | 12/1980 | Edwards et al. | 164/34 |
| 4,499,940 | A | 2/1985 | Hall | 164/36 |
| 4,660,623 | A | 4/1987 | Ashton | 164/518 |
| 4,736,786 | A | 4/1988 | Trumbauer | 164/23 |
| 4,877,078 | A | 10/1989 | Wittmoser | 164/34 |
| 4,982,781 | A | 1/1991 | Carpenter et al. | 164/526 |
| 5,735,336 | A | 4/1998 | Oti | 164/516 |

FOREIGN PATENT DOCUMENTS

| | | |
|---|---|---|
| JP | 59-73 146 | 4/1984 |
| JP | 2-247 039 | 10/1990 |
| JP | 8281372 | 10/1996 |

*Primary Examiner*—Kuang Y. Lin

(57) ABSTRACT

Method of making a shell mold for casting molten metals or alloys involves forming a thermally collapsible, low density reaction injection molded (RIM) thermosetting polyurethane foam pattern having a shape corresponding to the casting to be made. The pattern is formulated to have an aggregate density (pattern outer skin and pattern cellular core) in the range of about 10 to 15 lbs/ft$^3$ and a smooth continuous as-molded surface devoid of surface connected open cells, dimensional stability over a range of temperatures, and ready, ashless burnout from the shell mold formed thereon without cracking the shell mold. The pattern is free of organometallic catalysts that should not be present in the casting of aerospace superalloys, such as nickel and cobalt base superalloys and titanium. The pattern then is invested without the need for any surface polymer or other film or layer in a shell mold.

17 Claims, No Drawings

INVESTMENT CASTING PATTERNS AND METHOD

FIELD OF THE INVENTION

The present invention relates to the casting molten metals and alloys in shell molds and, more particularly, to fugitive patterns for use in forming the shell molds.

BACKGROUND OF THE INVENTION

In the well known "lost wax" process of investment casting, a fugitive or disposable wax pattern is made by injection molding melted wax in a die corresponding to the configuration of the component to be cast. The molded wax pattern then is invested in a ceramic shell mold by repeatedly dipping the pattern in a ceramic slurry, draining excess slurry, and stuccoing with coarse ceramic particles or stucco until a desired thickness of a ceramic shell mold is built-up on the pattern. The pattern then is removed from the green shell mold typically by heating the shell mold to melt out the pattern, leaving a ceramic shell mold which then is fired at elevated temperature to develop appropriate mold strength for casting a molten metal or alloy.

Attempts have been made to form fugitive patterns from polystyrene or polyurethane foam for practice of the "lost wax" process to make ceramic shell molds. However, polystyrene or polyurethane foam patterns have not been used in high volume commercial production of "lost wax" casting due to certain shortcomings of the patterns with respect to pattern surface quality, pattern strength, and difficulty in removal of the pattern from a shell mold invested therearound without cracking of the shell mold. For example expired U.S. Pat. No. 3,747,663 found that polystyrene or polyurethane foam patterns have easily damaged surfaces with a non-smooth, open cell surface structure. The patent coats the pattern with a film-forming polymer in a separate operation prior to being invested in a ceramic shell in order to overcome these problems.

An object of the invention is to provide a method of making a shell mold using a reaction injected molded polyurethane foam pattern as well as mold/pattern so formed wherein the pattern is formulated to have pattern surface, strength and other features that render the pattern suitable for making shell molds using "lost wax" process principles for high volume commercial production of castings without the need to coat the pattern with surface films or layers.

SUMMARY OF THE INVENTION

The present invention provides a method of making a shell mold for casting molten metals or alloys by forming a thermally collapsible, low density reaction injection molded (RIM) thermosetting polyurethane foam pattern having a shape corresponding to the casting to be made. The pattern is formulated preferably to have an aggregate pattern density in the range of about 10 to 15 lbs/ft$^3$ (pounds per cubic feet) to provide stiffness or rigidity sufficient to be invested in a shell mold without damage to the pattern yet replication of complex die features, a smooth continuous solid as-molded outer pattern skin or surface devoid of surface connected open cells from the underlying pattern internal microcellular core structure, dimensional stability over a range of temperatures, removability by ashless burnout from the shell mold formed thereon without cracking the shell mold. The pattern is free of organometallic catalysts that should not be present in the casting of aerospace superalloys, such as nickel and cobalt base superalloys. The pattern then is invested in a ceramic or refractory shell mold without the need for any surface polymer or other film on the pattern.

In an embodiment of the invention, the RIM polyurethane foam pattern is formed in a one step reaction injection molding operation using a polyol stream with particular additives and a prepolymer isocyanate stream that form polyurethane foam in an injection mold having die cavity shaped to correspond to the desired pattern shape. The polyol stream includes selected additives such as organic catalysts for controlling gelling and cross-linking, water blowing agent, and surfactant, that cooperate to produce a molded aggregate pattern density of about 10 to about 15 lbs/ft$^3$ and smooth pattern skin or surface.

In a particular embodiment of the invention, the pattern formulation consists essentially of, in parts by weight (pbw) of the formulation, a high molecular weight polyether polyol in an amount of about 20 to about 50 pbw, a lower molecular weight polyether polyol in an amount of about 50 to about 80 pbw, diamine skin-forming additive that assists in producing the smooth continuous defect-free pattern surface in an amount of about 5 to about 15 pbw, a chain extender in an amount of about 2.5 to about 10 pbw, water blowing agent in an amount of about 1 to about 4 pbw, non-silicone surfactant in an amount of about 1 to about 4 pbw, tertiary amine catalyst and amine catalyst in respective amounts of about 0.1 to about 1.0 pbw and about 0.05 to about 0.2 pbw to control blowing reaction, cross-linking and gelling catalyst in an amount of about 0.015 to about 0.075 pbw, and diisocyanate in an amount of about 79.23 to about 190.96 pbw with an isocyanate index of 102 to 105.

Objects and advantages of the invention will become more readily apparent from the following detailed description.

DETAILED DESCRIPTION OF THE INVENTION

The present invention provides a method of making shell molds using "lost wax" process principles for high volume commercial production of metal and alloy cast articles. The invention is especially useful in the precision investment casting of nickel and cobalt superalloy components, such as gas turbine engine blades and vanes having complex airfoil shapes as well as of titanium and titanium alloy components, although the invention is not limited in this regard and can be practiced in the casting of any metal or alloy.

An illustrative embodiment of the method of the invention involves forming a reaction injection molded thermosetting polyurethane foam pattern having a shape corresponding to the cast article or component to be made. The pattern is formed by one step reaction injection molding (RIM) wherein a polyol stream and an isocyanate stream are mixed and introduced into an injection mold having die cavity shaped to correspond to the desired pattern shape.

The pattern is made of a self-skinning RIM thermosetting rigid polyurethane foam (as opposed to elastomeric polyurethane foam) formulated to have an aggregate pattern density in the range of about 10 to 15 lbs/ft$^3$ (pounds per cubic feet), more preferably 12 to 15 lbs/ft$^3$, to provide stiffness or rigidity sufficient to be invested in a shell mold without damage to the pattern or mold yet replication of complex die features, a smooth continuous solid, relatively high density as-molded outer pattern skin or surface devoid of surface connected open cells and covering a relatively low density internal pattern microcellullar core structure having cell sizes of about 0.005 to 0.010 inch, dimensional stability over a range of temperatures, removability by ashless burnout from the shell mold formed thereon without cracking the shell mold. The aggregate pattern density is the density of the complete pattern including the smooth continuous solid as-molded outer pattern skin or surface and the underlying microcellular internal core structure. The pattern is substantially free of detrimental or excessive organometallic catalysts that should not be present in the casting of aerospace superalloys, such as nickel and cobalt base superalloys.

For example, the RIM rigid polyurethane foam pattern is formed in a one step reaction injection molding (RIM) operation using a prepolymer isocyanate stream and a polyol stream that includes selected additives such as catalysts for controlling gelling and cross-linking, water blowing agent, and surfactant, that cooperate to produce a molded aggregate pattern foam density of about 10 to about 15 lbs/ft$^3$, smooth outer pattern skin or surface, and other above described pattern features.

In a particular preferred embodiment of the invention, the polyurethane foam formulation comprises, in parts by weight (pbw) of the formulation, a high molecular weight polyether polyol in an amount of about 20 to about 50 pbw, a lower molecular weight polyether polyol in an amount of about 50 to about 80 pbw, diamine skin-forming additive that assists in producing the smooth continuous defect-free pattern surface in an amount of about 5 to about 15 pbw, a chain extender in an amount of about 2.5 to about 10 pbw, water blowing agent in an amount of about 1 to about 4 pbw, non-silicone surfactant in an amount of about 1 to about 4 pbw, tertiary amine catalyst and amine catalyst in respective amounts of about 0.1 to about 1.0 pbw and about 0.05 to about 0.2 pbw to control blowing reaction, cross-linking and gelling catalyst in an amount of about 0.015 to about 0.075 pbw, and diisocyanate in an amount of about 79.23 to about 190.96 pbw. The isocyanante index can be in the range of about 102 to about 105. The isocyanate index is well known and equals 100 times the ratio of free isocyanate groups to isocyanate reactive groups (hydroxyl, amine, water) before the reaction takes place. An isocyanate index of 100 is the exact number of equivalents of isocyanate as the total number of equivalents of hydroxyl, amine hydrogens, and water. In the formulation below, the isocyanate index of 104 means we multiply the total number of isocyanate reactive groups (number of equivalents) by 1.04.

An illustrative polyurethane formulation for reaction injection molding comprises, in parts by weight per hundred (pbw) of the formulation, is as follows:

| Formulation | pbw | Chemical Properties |
|---|---|---|
| 1) polyether polyol | 30 | OH# = 25, F = 3, MW = 6730 |
| 2) polyether polyol | 63 | OH# = 360, F = 4.5, MW = 725 |
| 3) polyoxypropylene diamine | 7 | MW = 400 |
| 4) chain extender | 7.5 | MW = 62 ethylene glycol |
| 5) water | 2 | |
| 6) surfactant | 1.5 | non-silicone |
| 7) tertiary amine catalyst | 0.1 | |
| 8) amine catalyst | 0.053 | |
| 9) organotin catalyst | 0.018 | |
| 10) diphenylmethane diisocyanate | 130.6 | NCO % = 29.5, F = 2.25, MW = 320 |
| isocyanate index | 104 | |

where OH#=hydroxyl number, F=functionality, MW=molecular weight, and NCO%=percent active NCO end groups.

Polyol constituent (1) is available as Pluracol-973 liquid polyol from BASF Corporation. Polyol constituent (2) is available as Voranol-240-360 liquid polyol from Dow Chemical Company. The diamine skin-forming additive (3) is available as Jeffamine D-400 additive from Huntsman Petrochemical Corporation. This constituent promotes the formation of the smooth continuous solid outer pattern skin or surface devoid of surface connected open cells from the underlying internal pattern microcellular core structure. The ethylene glycol chain extender constituent (4) is available from Chem Central Corporation. This constituent promotes hard segment concentration in the pattern resulting in more rigid or stiff (higher modulus of rupture) foam structure. The water is present as a blowing agent to control free rise density of the foam pattern, which is one parameter for controlling pattern density. The non-silicone surfactant is available as LK-221 surfactant from Air Products and Chemicals, Inc. The surfactant lowers surface tension to allow the polyurethane to support its own weight during foaming. The tertiary amine catalyst is available as Niax A-1 from OSI Product Specialties, Inc. and initiates and speeds blowing reaction to effect proper sequence of blowing to gelling reaction. The amine catalyst is available as Dabco-8154 catalyst from Air Products and Chemicals, Inc. and serves also to initiate and speed blowing reaction to effect proper sequence of blowing to gelling reaction. The organotin catalyst is available as Dabco T-12 catalyst from Air Products and Chemicals, Inc. and serves to control gel reaction (cross-linking) and synchronize with the blowing reaction to effect proper molding. The liquid diphenylmethane diisocyanate is available as Luprinate MM-103 from BASF Corporation. Except for Dabco T-12, the above catalysts are solely organic so that the pattern is substantially free of detrimental organometallic catalysts that should not be present in the casting of aerospace superalloys, such as nickel and cobalt base superalloys. Dabco T-12 catalyst includes tin but is present in such a small amount of the formulation that the tin level is consider as trace and insignificant.

The liquid polyol stream comprising the constituents (1) through (9) and the liquid prepolymer isocyanate stream comprising constituent (10) are conventionally mixed in a recirculation mix head of a conventional RIM machine and introduced into a conventional metal (e.g. aluminum or tool steel) mold forming a cavity shaped to correspond to the desired pattern shape under an injection pressure to the mix head in the range of 1000 to 2500 psi and flow rate of 100 to 400 grams/second to the RIM mold cavity so as to meter the proper amount of material into the RIM mold cavity typically in about 2 to 4 seconds. Since the surface finish of the RIM mold is closely replicated by the outer solid skin or surface of the polyurethane foam pattern, the RIM mold surface finish can be chosen to impart a desired finish to the pattern outer skin or surface and thus to the shell mold and casting ultimately solidified therein. The surface finish of the RIM mold thus can be tailored to the desired surface finish of the casting to be made in the shell mold.

The parting line of the RIM mold typically will be located at a surface of the pattern and thus the casting away from a critical surface. For example, for an airfoil shaped pattern, the RIM mold parting line will not fall on the airfoil concave or convex surfaces but rather may fall on the trailing edge of the airfoil where any flash can be removed prior to investing the pattern in the shell mold. The RIM mold can be made of steel or aluminum or other materials suitable for this purpose and conventionally known. A RIM machine available as model PS-30 from Hi-Tech Engineering, Inc. having actively heated/cooled mold halves can be used to mix the streams and reaction injection mold the pattern formulation to form a desired pattern shape. The machine includes a conventional air nucleator to control cell size and uniformity. The RIM mold is maintained at a temperature in the range of 120 to 180 degrees F. during injection and pattern molding. A mold release agent, such as urethane Parfilm available from Price-Driscoll Corporation, typically is applied to the injection mold surfaces prior to molding the pattern. The total molding time after injection of a typical pattern is in the range of 3 to 5 minutes.

The molded polyurethane foam pattern then is removed from the RIM mold by opening the mold halves and manually removing or automatically ejecting the pattern using knockout pins. The pattern is allowed to cool to room temperature after removal from the RIM mold prior to conduct of room temperature shell molding investment operations.

The molded pattern typically is not in need of cleaning after prior to the shell mold investment operations. The pattern may be cleaned if desired using a conventional pattern wash which may include a diluted citric acid in water solvent or diluted mineral spirits in a solvent. As mentioned above, the as-molded pattern surface is a smooth continuous solid outer pattern skin or surface devoid of surface-connected open cells of the underlying internal pattern microcellular core structure in the as-molded pattern condition. The outer solid skin or surface of the molded pattern typically is 0.002 to 0.005 inch in thickness, although the invention is not limited to any particular skin thickness value. The molded RIM polyurethane foam pattern then is invested in a ceramic or refractory shell mold by repeatedly dipping the pattern in a ceramic or refractory slurry, draining excess slurry, and stuccoing with coarse ceramic or refractory particles or stucco until a desired thickness of a shell mold is built-up on the pattern pursuant to the well known "lost wax" process principles. The initial ceramic or refractory slurry and stucco form the facecoat of the shell mold that contacts the molten superlloy when it is cast into the mold. The facecoat may comprise multiple slurry/stucco layers. The shell mold facecoat is backed or supported by a plurality of back-up layers. Shell mold facecoats and back-up layers for casting nickel and cobalt superalloys are well known an described, for example, in U.S. Pat. Nos. 5,335,717 and 5,297,615, the teachings of which are incorporated herein by reference. Mold facecoats and back-up layers for shell molds for casting titanium and titanium alloys are described in U.S. Pat. No. 4,703,806, the teachings of which are incorporated herein by reference. The particular facecoat and back-up layers chosen to form the shell mold do not form part of the present inivention. Those skilled in the art will appreciate that the shell mold facecoat and back-up layers can be varied as described depending upon the molten metal or alloy to be cast in the mold.

After the shell mold is formed to a desired green (non-fired) shell mold wall thickness, the pattern is selectively burned out from the green shell mold typically by heating the shell mold with the pattern therein in an oven, furnace, or other heating device. The shell mold/pattern assembly can be heated in the range of 800 to 1600 degrees F. in air to selectively burn out the RIM polyurethane foam pattern without cracking the green shell mold. The pattern begins to soften at about 450 degrees F. and then collapses with further heating. The pattern is burned out without a phase change of the thermosetting polyurethane foam to a liquid so as to avoid cracking the green shell mold. Advantageously, the pattern can be burned out with essentially zero ash left in the shell mold from pattern decomposition. The invention thus provides for easy, ashless pattern removal from the green shell mold without shell mold cracking. The green shell mold with the pattern therein can be subjected to an optional isostatic gas pressure treatment at elevated gas (e.g. air) pressure and temperature prior to the pattern burnout operation, for example, as set forth in the Example below. Following removal of pattern, the shell mold is conventionally preheated or fired at elevated temperature suited to the particular ceramic or refractory used to fabricate the mold in order to develop adequate shell mold strength for casting of the molten metal or alloy therein. Parameters for firing of a shell mold for casting nickel or cobalt base superalloys are described in the above cited patents incorporated herein by reference.

EXAMPLE

For purposes of illustration and not limitation, the following Example is offered. A RIM polyurethane foam pattern of the above formulation was molded in a steel RIM mold that was electrical discharge machined (EDM'ed) and polished to have a shape of a turbogenerator wheel. The pattern was made using the following RIM parameters of 2000 psi mix pressure, 200 grams/second flow rate, an 0.2 second shot time and mold temperature of 120 degrees F. and mold release agent comprising Parfilm agent mentioned above. The molded pattern had an aggregate density of about 15 lbs/ft$^3$ and a smooth defect-free solid outer skin or surface overlying a microcellular core. The pattern was invested directly without cleaning in a ceramic shell mold using "lost wax" process techniques (i.e. repeated dipping in ceramic slurry, draining slurry and stuccoing) such that the shell mold had a cobalt aluminate nucleated facecoat and back-up layers comprising alumina and zircon. The green shell mold had a wall thickness generally up to 0.5 inch. The green shell mold with the pattern therein was subjected to isostatic gas (e.g. air) pressure at 500 psi and 400 degrees F. for 30 minutes. The mold/pattern then was heated to 1600 degrees F. in a box furnace in air for a time of 60 minutes to burnout the pattern with zero ash present in the shell mold and without cracking the green shell mold. The green shell mold then was preheated up to 2200 degrees F. for 3 hours to prepare for casting of a molten nickel based superalloy. A molten metal or alloy then can be cast into the fired shell mold by any conventional casting technique to form one or more cast articles which have the shape of the fugitive pattern used to make the shell mold. Casting of nickel or cobalt base superalloys or titanium alloys into shell molds is described in the above cited patents incorporated herein by reference.

The polyurethane foam patterns and the shell molds so produced therewith are especially useful in casting nickel or cobalt base superalloy gas turbine engine blades or vanes having complex or simple airfoil shapes and titanium metal and alloy components. The airfoil castings can be cast to have an equiaxed, columnar grain or single crystal microstructure as needed for a particular service application. However, the invention is not limited to any particular casting technique or metal or alloy being cast.

We claim:

1. A method of making a shell mold for casting a molten metal or alloy, comprising:

forming a reaction injection molded thermosetting polyurethane loam pattern having a shape corresponding to a cast article to be made, said pattern having a smooth continuous as-molded pattern surface devoid of surface connected open cells from an underlying cellular structure of the pattern, forming a shell mold about the pattern, and heating the shell mold and the pattern in a manner to selectively remove the pattern from the shell mold without shell mold cracking prior to introducing the molten metal or alloy in said shell mold.

2. The method of claim 1 wherein the pattern has an aggregate pattern density in the range of about 10 to about 15 lbs/ft$^3$.

3. The method of claim 1 including forming the pattern by one step reaction injection molding wherein a polyol stream and an isocyanate stream are mixed and introduced into an injection mold having a die cavity shaped to correspond to the desired pattern shape.

4. The method of claim 3 wherein the polyol stream includes additives comprising one or more organic catalysts for controlling gelling and cross-linking, a water blowing agent, and surfactant that cooperate to produce a molded aggregate pattern density of about 10 to about 15 lbs/ft$^3$ and as-molded smooth pattern surface.

5. The method of claim 4 wherein said pattern is formed by reaction injection molding of a polyurethane formulation consisting essentially of, in parts by weight (pbw) of the formulation, a high molecular weight polyether polyol in an amount of about 20 to about 50 pbw, a lower molecular weight polyether polyol in an amount of about 50 to about 80 pbw, skin-forming additive in an amount of about 5 to about 15 pbw, a chain extender in an amount of about 2.5 to about 10 pbw, water in an amount of about 1 to about 4 pbw, surfactant in an amount of about 1 to about 4 pbw, tertiary amine catalyst and amine catalyst in respective amounts of about 0.1 to about 1.0 pbw and about 0.05 to about 0.2 pbw to control blowing reaction, cross-linking and gelling catalyst in an amount of about 0.015 to about 0.075 pbw, and diisocyanate in an amount of about 79.23 to about 190.96 pbw to provide an isocyanate index of 102 to 105.

6. The method of claim 1 wherein said pattern is removed from the shell mold by burnout without ash.

7. A reaction injected molded thermosetting pattern for making a shell mold for casting molten metals and alloys, having an aggregate pattern density in the range of about 10 to about 15 lbs/ft$^3$ and a smooth continuous as-molded surface devoid of surface connected open cells from an underlying cellular structure of the pattern.

8. he pattern of claim 7 is made by reaction injection molding an isocyanate stream and a polyol stream that includes additives comprising one or more organic catalysts for controlling gelling and cross-linking, a water blowing agent, and surfactant that cooperate to produce a molded aggregate pattern density of about 10 to about 15 lbs/ft$^3$ and smooth pattern surface.

9. The pattern of claim 8 wherein said pattern is formed by reaction injection molding a polyurethane formulation consisting essentially of, in parts by weight (pbw) of the formulation, a high molecular weight polyether polyol in an amount of about 20 to about 50 pbw, a lower molecular weight polyether polyol in an amount of about 50 to about 80 pbw, skin-forming additive in an amount of about 5 to about 15 pbw, a chain extender in an amount of about 2.5 to about 10 pbw, water in an amount of about 1 to about 4 pbw, surfactant in an amount of about 1 to about 4 pbw, tertiary amine catalyst and amine catalyst in respective amounts of about 0.1 to about 1.0 pbw and about 0.05 to about 0.2 pbw to control blowing reaction, cross-linking and gelling catalyst in an amount of about 0.015 to about 0.075 pbw, and diisocyanate in an amount of about 79.23 to about 190.96 pbw.

10. The combination of a shell mold and a fugitive, reaction injected molded thermosetting pattern in said shell mold and having an aggregate pattern density in the range of about 10 to about 15 lbs/ft$^3$ and a smooth continuous as-molded surface devoid of surface connected open cells from an underlying cellular structure of the pattern.

11. The combination of claim 10 wherein said pattern is made by reaction injection molding an isocyanate stream and a polyol stream that includes additives comprising one or more organic catalysts for controlling gelling and cross-linking, a water blowing agent, and surfactant that cooperate to produce a molded aggregate pattern density of about 10 to about 15 lbs/ft$^3$.

12. The combination of claim 10 wherein said pattern is formed by reaction injection molding a polyurethane formulation consisting essentially of, in parts by weight (pbw) of the formulation, a high molecular weight polyether polyol in an amount of about 20 to about 50 pbw, a lower molecular weight polyether polyol in an amount of about 50 to about 80 pbw, a skin-forming additive in an amount of about 5 to about 15 pbw, a chain extender in an amount of about 2.5 to about 10 pbw, water in an amount of about 1 to about 4 pbw, surfactant in an amount of about 1 to about 4 pbw, tertiary amine catalyst and amine catalyst in respective amounts of about 0.1 to about 1.0 pbw and about 0.05 to about 0.2 pbw to control blowing reaction, cross-linking and gelling catalyst in an amount of about 0.015 to about 0.075 pbw, and diisocyanate in an amount of about 79.23 to about 190.96 pbw.

13. The combination of claim 12 wherein said formulation is substantially free of a organometallic catalyst.

14. Method of investment casting a metal or alloy comprising:

forming a reaction injection molded thermosetting polyurethane foam pattern having a shape corresponding to the casting to be made, said pattern having an aggregate pattern density in the range of about 10 to about 15 lbs/ft$^3$ and a smooth continuous as-molded surface devoid of surface connected open cells, forming a shell mold about the pattern, heating the shell mold and the pattern in a manner to selectively remove the pattern from the shell mold without shell mold cracking, heating the shell mold to provide mold strength for casting, and casting a molten metal or alloy in the shell mold that is devoid of said pattern.

15. The method of claim 14 wherein the pattern is molded to have an airfoil shape.

16. The method of claim 14 wherein the metal or alloy comprises one of a nickel base superalloy, cobalt base superalloy, titanium and titanium alloy.

17. Method of investment casting a metal or alloy comprising:

forming a reaction injection molded thermosetting polyurethane foam pattern having a shape corresponding to the casting to be made, said pattern having a continuous as-molded surface devoid of surface connected open cells, forming a shell mold about the pattern, heating the shell mold and the pattern in a manner to selectively remove the pattern from the shell mold without shell mold cracking, heating the shell mold to provide mold strength for casting, and casting a molten metal or alloy in the shell mold that is devoid of said pattern.

* * * * *

UNITED STATES PATENT AND TRADEMARK OFFICE

CERTIFICATE OF CORRECTION

PATENT NO. : 6,481,490 B1 
DATED : November 19, 2002
INVENTOR(S) : Joseph M. Vihtelic et al.

It is certified that error appears in the above-identified patent and that said Letters Patent is hereby corrected as shown below:

Column 6,
Line 63, replace “loam” with -- foam --.

Column 7,
Line 43, replace “he” with -- The --.

Signed and Sealed this

Twenty-ninth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,481,490 B1 
DATED : November 19, 2002
INVENTOR(S) : Joseph M. Vihtelic et al.

It is certified that error appears in the above-identified patent and that said Letters Patent is hereby corrected as shown below:

Column 8,
Line 36, after "open cells" insert -- from an underlying cellular structure of the pattern --.
Lines 55-56, after "open cells" insert -- from an underlying cellular structure of the pattern --.

Signed and Sealed this

Eighteenth Day of November, 2003

JAMES E. ROGAN
*Director of the United States Patent and Trademark Office*